United States Patent [19]

Arons et al.

[11] 4,067,210

[45] Jan. 10, 1978

[54] WARP KNIT FABRIC CONTAINING WEFT OF PROTECTIVE YARN-COVERED ACTIVATED-CARBON YARN

[75] Inventors: Gilbert N. Arons, Newton Highlands; Laurance G. Coffin, Westwood; Richard N. Macnair, Cambridge, all of Mass.

[73] Assignee: The United States of America as represented by the Secretary of the Army, Washington, D.C.

[21] Appl. No.: 621,730

[22] Filed: Oct. 14, 1975

[51] Int. Cl.[2] ..... D04B 7/16; D04B 23/08

[52] U.S. Cl. ..... 66/202; 66/192; 139/420 R

[58] Field of Search ..... 66/202, 195, 192, 190; 8/189; 423/447; 428/248; 139/426

[56] References Cited

U.S. PATENT DOCUMENTS

| | | | |
|---|---|---|---|
| 3,235,323 | 2/1966 | Peters | 8/189 |
| 3,474,644 | 10/1969 | Frank | 66/195 X |
| 3,556,712 | 1/1971 | Yoneshige et al. | 8/116 |
| 3,639,140 | 2/1972 | Miyamichi | 8/189 |
| 3,744,534 | 7/1973 | Henry et al. | 139/426 |

*Primary Examiner*—Ronald Feldbaum
*Attorney, Agent, or Firm*—Nathan Edelberg; Robert P. Gibson; Charles C. Rainey

[57] ABSTRACT

A warp knit fabric containing weft inserted protective yarn-covered activated-carbon yarn which is particularly adapted for use in clothing for protection of the wearer against toxic chemical vapors or gases, the toxic vapors being sorbed by the activated-carbon yarn portion of the weft. Non-carbon yarns are used in the warp.

10 Claims, 3 Drawing Figures

WARP KNIT FABRIC CONTAINING WEFT OF PROTECTIVE YARN-COVERED ACTIVATED-CARBON YARN

The invention described herein may be manufactured, used, and licensed by or for the Government for governmental purposes without the payment to us of any royalties thereon.

BACKGROUND OF THE INVENTION

This invention relates to warp knit fabrics which contain highly activated carbon yarn and which are, accordingly, highly sorbent with respect to toxic chemical vapors.

Activated carbon yarns are generally produced by pyrolyzing in an inert atmosphere at an elevated temperature a yarn prepared from filaments of a polymeric carbonaceous material, such as viscose rayon, phenolic polymers, polyacrylonitrile, or other fiber-forming materials. After such yarns are pyrolyzed to convert the polymeric filaments into carbon filaments, the yarns are activated by controlled oxidation at even higher temperatures than those employed during the pyrolysis. This may be carried out in atmospheres of carbon dioxide or superheated steam or flue gas or air or even oxygen. The oxidation, when properly controlled with respect to a carbon yarn derived from a suitable precursor yarn subjected to a suitable pyrolysis reaction, results in a yarn made of fibers of noncrumbling carbon having a good distribution of pore sizes, thus providing a highly active yarn in terms of surface area available for sorption of toxic chemical vapors or gases and in terms of quantity of toxic chemical vapor or gas sorbed. Such highly activated carbon yarns and fabrics are described in an article entitled "Sorptive Textile Systems Containing Activated Carbon Fibers" by Gilbert N. Arons, Richard N. Macnair, Laurance G. Coffin, and Hubertina D. Hogan, Textile Research Journal, Vol. 44, No. 11, Nov. 1974,874–883, and in an article entitled "Activated Carbon Fabric Prepared by Pyrolysis and Activation of Phenolic Fabric" by Gilbert N. Arons and Richard N. Macnair, Textile Research Journal, Vol. 45, No. 1, January 1975, 91. Other relevant publications include the following articles: "Sorption Characteristics of Activated Carbon Fabric" by Gilbert N. Arons, Richard N. Macnair, and Richard L. Erickson, Textile Research Journal, Vol. 43, No. 9, September 1973, 539–543; and "Activated Carbon Fiber and Fabric Achieved by Pyrolysis and Activation of Phenolic Precursors" by Gilbert N. Arons and Richard N. Macnair, Textile Research Journal, Vol. 42, No. 1, January 1972, 60–63.

It is also known to produce woven protective clothing fabric made of activated carbon yarns in combinations with aromatic polyamide yarns which are flame-resistant, as disclosed in U.S. Pat. No. 3,744,534. Also, reinforced activated-carbon fabrics have been produced by laminating relatively weak activated carbon fabric to one or two non-carbon fabrics having good strength, thus providing support for the carbon fabric without substantially reducing the permeability of the fabric layers, including the activated carbon fabric layer, thus maintaining the ability of the activated carbon fabric to sorb toxic chemical vapors and gases while obtaining good strength and other desirable textile characteristics in the composite fabric, as disclosed in U.S. Pat. No. 3,850,785.

Weaving of fabrics containing activated carbon yarns has proven to be slow and expensive, and unadaptable to commercial weaving machinery and practices because of the very low strengths of activated carbon yarns. Hence, there has been no commercial development of activated carbon fabrics for protective clothing for use in areas where toxic chemical vapors create a serious hazard to life or health. It has been necessary, therefore, until now, for protective clothing to be made of materials of low permeability, such as polymeric foam overgarments impregnated with activated carbon because of the extremely high cost of woven fabrics made of or containing substantial quantities of active carbon yarns. Such materials create a severe problem in terms of comfort and greatly limit the time during which a human being can operate in an area containing toxic chemical vapors because of physiological stress due to excessive thermal insultion.

It is, therefore, an object of the invention to provide fabrics containing highly active carbon yarns which are suitable for use in making highly air-permeable clothing which will substantially completely sorb toxic chemcial vapor or gas agents present in air premeating such clothing, and which are capable of being produced on commercially available fabric-forming machines at or near current commercial production speeds.

Other objects and advantages will appear from the following description of the invention, and the novel features will be particularly pointed out in connection with the appended claims.

SUMMARY OF THE INVENTION

The objective of the present invention is accomplished by providing warp knit fabrics made of highly activated carbon yarn which is protected by being braided with a protective yarn which forms a covering over the carbon yarn, or by being wrapped with a protective yarn which forms a covering over the carbon yarn, the protective yarn-covered activated-carbon yarn being incorporated as the weft in a warp knit fabric by a weft insertion procedure which may operate at commercially acceptable speeds without putting the weft yarn under great strain or subjecting it to severe abrasion. The warp yarn may be any of a large number of commercially available conventional yarns for use in warp knitting. The resulting warp knit fabrics are quite permeable to air and therefore quite comfortable when incorporated in clothing, possess good stretchability because of the warp knit construction, are quite strong and durable, and have excellent sorptive power for toxic chemical vapors, or gases, thus being well adapted for use as the outermost layer of protective clothing to be worn in environments where high concentrations of toxic chemical vapors or gases are present.

DESCRIPTION OF THE PREFERRED EMBODIMENTS

The invention is illustrated by the drawing in which.

Figure 1:
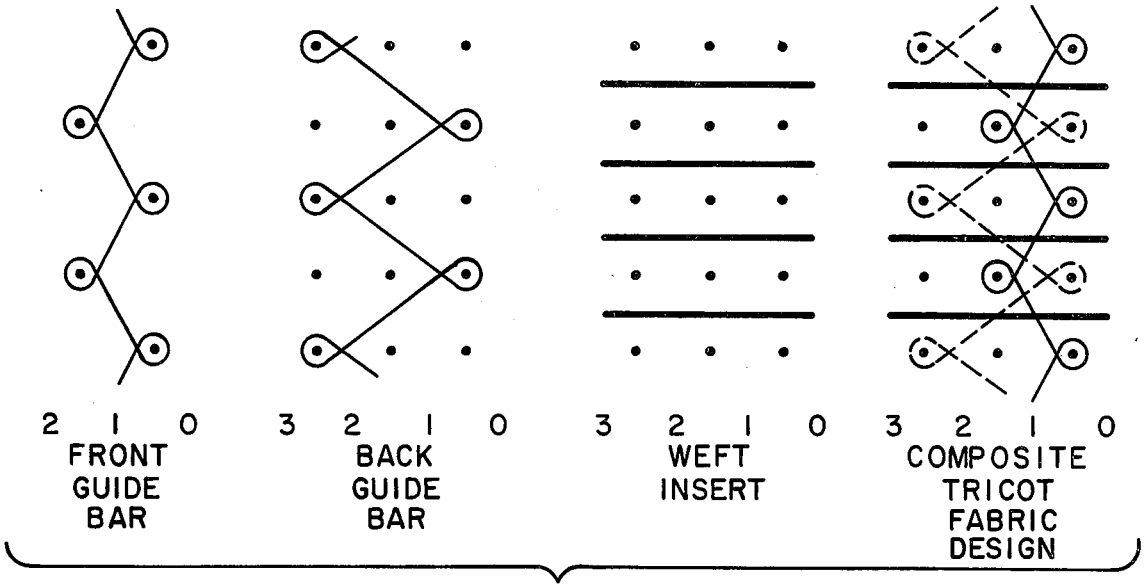
FIG. 1 is a point diagram for a tricot type warp knit fabric as described in Example I.
Figure 2:
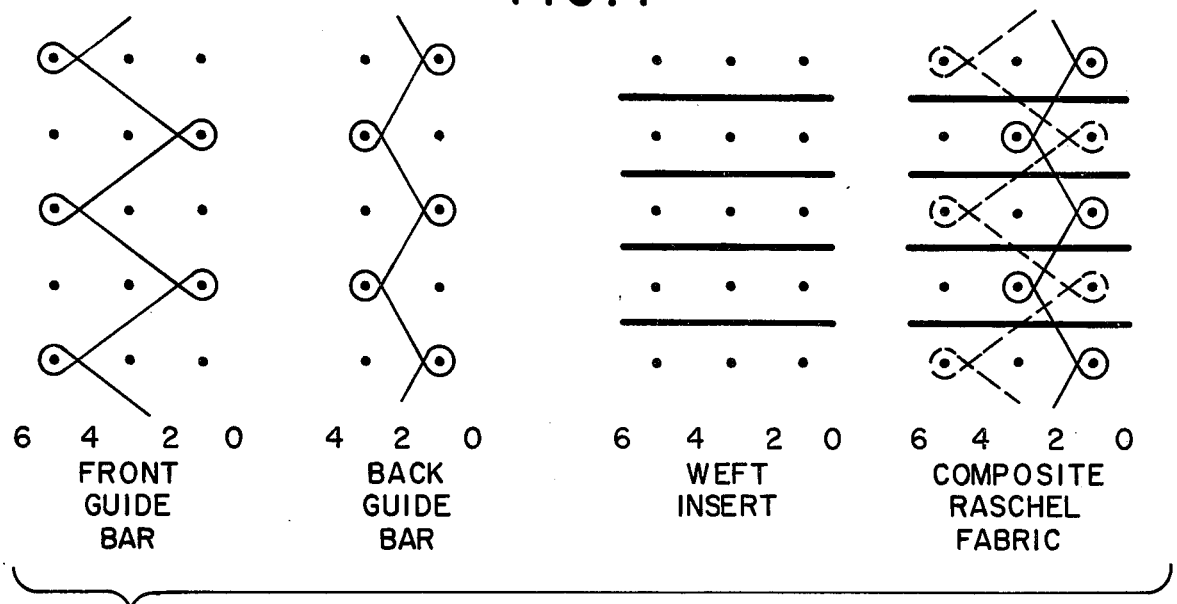
FIG. 2 is a point diagram for a raschel type warp knit fabric as described in Example II.
Figure 3:
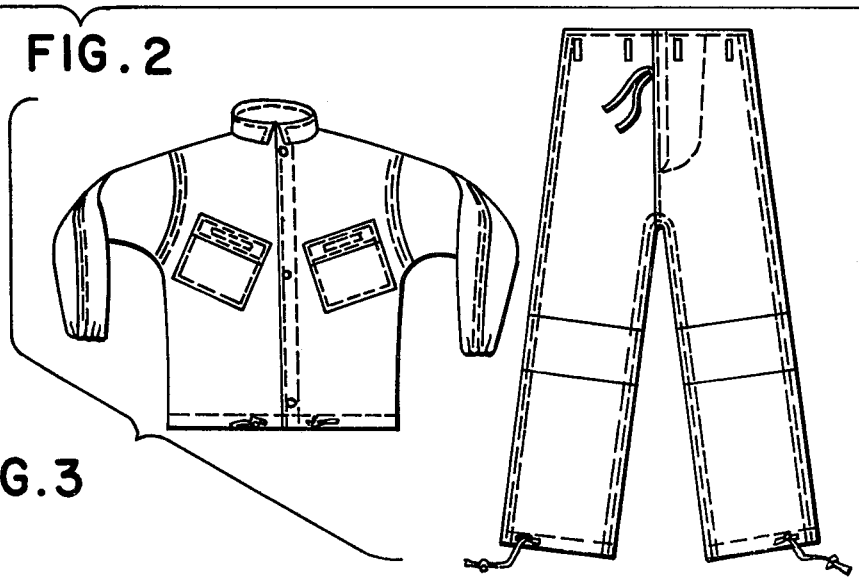
FIG. 3 is a protective clothing garment made of a warp knit fabric for protection of a wearer thereof against a toxic chemical vapor or gas agent, such as the tricot warp knit fabric of Example I or the raschel warp knit fabric of Example II, conforming in general design, but not in the fabric structure, to the Suit, Chemical Protective of Military Specification MIL-S-43,926, dated Apr. 3, 1975.

The drawing will be understood by persons skilled in the art without further detailed description thereof.

Carbon yarns are available in many different types having differing physical properties, especially widely varying degrees of activation of the carbon material, which determines the toxic chemical vapor sorptivity of the carbon yarns and fabrics containing such yarns. A carbon yarn as employed herein is a yarn comprised of fibers having a carbon content of from about 50 up to about 99+ percent by weight. For the purposes of the invention, it is preferred that the activated-carbon yarns employed in carrying out the invention have a saturated carbon tetrachloride vapor sorption capacity of at least 60 percent by weight and that the weft inserted warp knit fabrics comprising protective yarn-covered activated-carbon yarns inserted as weft in accordance with the invention have a sorptivity for carbon tetrachloride vapor of at least 1 mm/cm$^2$ of fabric. The degree of activation of the carbon has a finite upper limit which is governed in part by the nature of the carbon yarn precursor as well as the activation conditions or procedures used in activating the carbon yarns, which are well known to those skilled in the art. The activated-carbon yarns generally have surface areas in the range from about 250 to about 1200 m$^2$/gm. The pores therein, which provide these large surface areas and the high sorption capacity of the activated-carbon yarns for carbon tetrachloride and other toxic chemical vapors, may be classified according to size as follows: micropores having less than 30 A diameter, transistional pores in the 30 A to 2000 A diameter range, and macropores of over 2000 A diameter.

One of the most active of the carbon yarns is produced from a precursor yarn which is a tire cord type of viscose rayon yarn. In general, activated-carbon yarns having a significant vapor or gas sorption capacity have relatively poor tensile properties, normally having a tenacity of less than 1 gm./denier, as well as poor abrasion resistance and poor flexing properties. Descriptions of suitable carbon yarns and methods of manufacturing the same may be found in U.S. Pat. No. 3,235,323 to E. N. Peters and U.S. Pat. No. 3,556,712 to Yoneshige et al. Examples of commercially available activated-carbon yarns meeting the requirements of this invention are Pluton HT-1, Pluton PX 563, both products of 3M Company, and VYC 70-½ carbon yarn, a product of Union Carbide Corporation.

The activated-carbon yarns employed in carrying out the invention are reinforced and protected against abrasion by being covered with a protective yarn, e. g. a cotton yarn, covering which is preferably applied by braiding the protective yarn over the activated-carbon yarn as a core in a conventional braiding process, but may also be applied by wrapping the protective yarn around the activated-carbon yarn as a core in a conventional yarn-wrapping process. The activated-carbon yarn core preferably constitutes at least 30 percent by weight of the protective yarn-covered activated-carbon yarn in order that the warp knit fabric produced therewith serving as the weft component will have sufficient sorptivity for toxic chemical vapors and gases. The protective yarn-covered activated-carbon yarn employed in accordance with the invention preferably has a tenacity of at least 1 gram per denier.

The warp yarn employed in the invention may be any of a large number of commercially available non-carbon yarns having a tenacity of from about 2 gm/denier up. The warp yarn may be such a high tenacity yarn as Nomex, an aramide fiber product of E. I. du Pont de Nemours & Co., or nylon, silk, polyester, viscose rayon, acetate rayon, acrylic, modacrylic, cotton, or wool yarns, or other non-carbon yarns.

The protective yarn employed for covering the activated-carbon yarn may be made of short, medium, or long staple cotton. Being a staple yarn, it provides good protection for the activated-carbon yarn since the free ends of the cotton fibers stick out at many points along the cotton-covered activated-carbon yarn and absorb a high percentage of the abrasive forces to which the cotton-covered activated-carbon yarn may be exposed. Thus the cotton braiding or wrapping adds strength to the fabric and protects it against abrasion. The protective yarn employed for covering the activated-carbon yarn may also be made of various other fibers, such as wool, rayon, cellulose acetate, or various synthetic fibers. These protective yarns may be made of staple fibers or of continuous filaments.

The warp knit fabrics of this invention have non-carbon yarn in the warp while protective yarn-covered activated-carbon yarn is weft inserted a selected number of courses per inch to provide a warp knit fabric which has high sorptive capacity for toxic chemical vapors and gases, is reasonably strong, and has sufficiently good abrasion resistance to retain a large amount of sorptivity for toxic chemical vapors even after being subjected to considerable abrasion. The warp knit fabrics may be produced on tricot type or raschel type warp knitting machines modified so as to insert the protective yarn-covered activated-carbon yarn as weft while the non-carbon yarn is being warp knitted. Such apparatuses and methods are exemplified by U.S. Pat. No. 3,364,701 and U.S. Pat. No. 3,495,423.

It is preferred for the purposes of the invention that the warp knit fabric contain at least 3 oz/yd$^2$ of the activated-carbon yarn. It is also preferred that the warp knit fabric have an air permeability of at least 50 cubic feet/minute/square foot of fabric. Clothing constructed of warp knit fabric having the above-stated preferred characteristics will be effective for protecting the wearer of such clothing against toxic chemical vapors or gases for a reasonable length of time, depending on the concentration of such vapors or gases in the atmosphere, and may be worn without experiencing undue heat stress since the fabric breathes while sorbing the toxic chemical vapors or gases.

The invention may be better understood by reference to the following examples, which are for illustrative purposes, and are not intended to limit the scope of the invention.

EXAMPLE I

A 15 oz/yd$^2$ warp knit fabric containing a weft inserted cotton-braided activated-carbon yarn is produced in the following manner.

The activated-carbon yarn is a 120 tex (1100 denier), 2-ply, yarn of the type identified as type ISPD 375, manufactured by the 3M Company, St. Paul, Minn, prepared from a continuous filament tire cord type viscose rayon yarn by pyrolyzing and activating the viscose rayon yarn in a conventional manner. The activated-carbon yarn has a saturated carbon tetrachloride vapor sorption capacity of 78.0 percent by weight and a tenacity of 2 grams per denier. the activated-carbon yarn is then covered with cotton by braiding 16 ends (eight ends in each of opposite directions) of a 7.6 tex (78/1 cotton count) cotton yarn over the activated-carbon yarn serving as a core, using an eight carrier standard braiding machine, modified with a vacuum pickup to remove any lint produced during the braiding operation. The braiding is carried out at a speed of 18 inches per minute. The resulting cotton-braided activated-carbon yarn is used as the weft insert yarn for weft insertion in a tricot warp knit fabric produced on a Karl Mayer Weftamatic Warp Knit Machine, Type KL 4, using a 12 tex (110 denier) spun Nomex yarn, solution dyed to an O. G. 106 shade, as the warp yarn. The Weftamatic machine is of 28 gauge with two yarn guide bars, each fully threaded, so that for each inch of fabric there are 56 Nomex ends, 28 to each guide bar. The fabric design data are as follows:

Quality — 18.8 inches of fabric/rack (480 courses)
Runner length (inches of warp yarn/rack):
  front bar — 105 inches
  bottom bar — 112 inches
Design pattern: —
  front guide bar: 1.0, 1-2
  back guide bar: 2-3, 1-0
Inserts/inch (weft): 27

The speed of producing the weft inserted warp knit fabric is 60 courses per minute, producing the 15 oz/yd$^2$ fabric, of which 4 oz/yd$^2$ is activated carbon in the weft inserted cotton-braided activated-carbon yarn component of the fabric. The average thickness of the fabric is 0.048 inch. The air permeability of the fabric is 110 ft$^3$/minute/ft$^2$ of fabric. The fabric has a breaking strength of 128 lb/in. in the warp direction and 200 lb/in. in the weft direction. It has a sorptivity of 2.0 mg/cm$^2$ of carbon tetrachloride as determined by a dynamic carbon tetrachloride absorption test (see Military Specification MIL-C-43858 (GL), dated Sept. 5, 1973) in which air containing 5 mg of carbon tetrachloride per liter is passed through the fabric at the rate of 1 liter/minute up to the point at which carbon tetrachloride is detected passing through the fabric. The fabric has good abrasion resistance as shown by its 850-cycle value produced on a sand abrader, such as that described in Technical Report TS-163, 70-2-CE, of the U.S. Army Natick Laboratories, "The Wear Resistance of Cotton Textiles" by Louis I. Weiner, available through the National Technical Information Service, Department of Commerce, Springfield, VA, 22161 under AD No. 692865. The fabric has a clo value of 1.58 determined in accordance with Technical Report TS-162, 69-74-CE, of the U.S. Army Natick Laboratories, "The Comfort And Functioning of Clothing" by Lyman Fourt and Norman R. S. Hollies, available through the National Technical Information Service under AD No. 703143. This clo value compares favorably in terms of comfort with the clo value of 2.0, which is characteristic of the chemical protective clothing material presently employed for military purposes, which is a nylon tricot knit cloth material laminated to a polyurethane foam and which is covered by the above-mentioned Military Specification. A conventional business suit has a clo value of about 1.0

EXAMPLE II

A 16.5 oz/yd$^2$ warp knit fabric containing a weft inserted activated-carbon yarn which is double wrapped with cotton yarn is produced in the following manner.

The activated-carbon yarn is a 156 tex (1400 denier), 2-ply, yarn manufactured by the Union Carbide Corporation, New York, N. Y., of the type identified as type VYC 70-½, prepared from a continuous filament viscose rayon yarn by pyrolyzing and activating the viscose rayon yarn in a conventional manner. The activated carbon yarn has a tenacity of 1.3 grams per denier. The activated-carbon yarn is then double wrapped with a total of 64 wraps per inch (approximately 32 wraps per inch in one direction, then approximately 32 wraps per inch in the opposite direction) with a 20 tex cotton yarn, employing an Arnold rubber covering machine operating at a throughput speed of approximately 8 yards per minute for the wrapping of the activated-carbon yarn. The resulting double-wrapped activated-carbon yarn is used as the weft insert yarn for weft insertion in a raschel warp knit fabric produced on a Barfuss Turbotex Wrap Knit Machine, using a 12 tex (110 denier) spun Nomex yarn, dyed olive green, with a 4.25 twist multiple, as the warp yarn. No size or finish is applied to the warp yarn. The Turbotex machine is of 48 gauge with two yarn guide bars, each fully threaded, so that for each inch of fabric there are 48 Nomex ends, 24 to each guide bar. The fabric design data are as follows:

Quality — inches/rack
Runner length:
  front bar — 117 inches
  back bar — 96 inches
Stitch:
  front bar: 4-6, 2-0
  back bar: 2-0, 2-4
Insertions/inch (weft) 25

The production speed of the weft inserted warp knit fabric is 200 courses per minute, producing the 16.5 oz/yd$^2$ fabric, of which 5.4 oz/yd$^2$ is activated carbon, in the weft inserted cotton-wrapped activated-carbon yarn component of the fabric. The average thickness of the fabric is 0.046 inch. The air permeability of the fabric is 93 ft$^3$/minute/ft$^2$ of fabric. The fabric has a breaking strength of 106 lb/in. in the wrap direction and 45 lb/in. in the weft direction. The fabric has good abrasion resistance as shown by the 1825-cycle value produced on a sand abrader, such as described in Example I. It has a clo value of 1.54.

It is apparent from the foregoing examples of the practice of the invention that braiding of the activated-carbon yarn is preferred to wrapping thereof with a covering cotton yarn when breaking strength of the wrap knit fabric in the weft direction is of great importance. However, when cost is of prime importance, the use of cotton-wrapped activated-carbon yarn in the weft inserted component is preferred, wrapping being less expensive than braiding, generally speaking. With a cotton yarn or other protective yarn covering, particularly when the covering is braided over the activated-carbon yarn core, warp knit fabrics such as those described above may be produced at reasonably economic speeds and with good overall textile characteristics by weft insertion of the activated-carbon yarn covered with cotton or other protective yarn, and the resulting warp knit fabrics may be effectively employed in making clothing to be worn when exposure of the wearer to toxic chemical vapors or gases, or even toxic liquids in some cases, is anticipated.

Instead of the braided or wrapped cotton-covered activated-carbon yarns for weft insertion in warp knit fabrics, activated-carbon yarns which have been electrically charged and covered with cotton fibers carrying the opposite electrical charge may be used as the weft yarn. The resulting weft inserted warp knit fabric has a relatively low breaking strength in the weft direction; but for some purposes where appreciable sorptivity for toxic chemical vapors is required without requiring very high breaking strength, and particularly when low cost is of great importance, such fabrics will prove adequate in breaking strength and quite effective for protection against toxic chemical vapors. Most clothing for use in protecting against toxic chemical vapors and gases will be discarded after a single wearing. Hence, the need for reducing the overall cost of the clothing is important so long as the cotton-covered activated-carbon yarn can be introduced by weft insertion in a warp knit fabric and the resulting fabric satisfactorily made into clothing. The weft insertion warp knitting process causes the least damage to activated-carbon yarns of any method known for producing fabrics. Covering of the activated-carbon yarns with cotton in any of the forms described above makes possible faster wrap knitting with weft insertion than would be possible without the cotton covering.

While the invention has been described in terms of warp knit fabrics produced with weft insertion of protective yarn-covered activated-carbon yarn to provide toxic vapor sorptive capacity to the fabrics, it is to be understood that similar results may be obtained employing weft knitting machines in which wrap yarns of the protective yarn-covered activated-carbon yarn type are inserted and held in place in the fabric by the knit weft yarn.

We wish it to be understood that we do not desire to be limited to the exact details described, for obvious modifications will occur to a person skilled in the art.

We claim:

1. An improved warp knitted activated-carbon fabric, said fabric having a weft comprising a protective yarn-covered activated-carbon yarn every course thereof being inserted across the full width of said fabric and having non-activated-carbon warp yarns in the wales and courses of said fabric, said fabric being a tricot knit fabric having a design represented by the bar movement pattern:

front guide bar: 1-0, 1-2
back guide bar: 2-3, 1-0
back guide bar: 2-0, 2-4.

2. An activated-carbon fabric according to claim 1, wherein said protective yarn-covered activated-carbon yarn is braided with a cotton yarn.

3. An activated-carbon fabric according to claim 1, wherein said protective yarn-covered activated-carbon yarn is wrapped with a cotton yarn.

4. An activated-carbon fabric according to claim 1, wherein said protective yarn-covered activated-carbon yarn is braided with a wool yarn.

5. An activated-carbon fabric according to claim 1, wherein said activated-carbon fabric has a sorptivity for carbon tetrachloride vapor of at least 1 $mg/cm^2$ of fabric.

6. An activated-carbon fabric according to claim 1, wherein at least 30 percent by weight of the protective yarn-covered activated-carbon yarn is an activated-carbon yarn.

7. An activated-carbon fabric according to claim 2, wherein at least 30 percent by weight of said activated-carbon yarn braided with cotton yarn is an activated-carbon yarn and said activated-carbon fabric has a sorptivity for carbon tetrachloride vapor of at least 1 $mg/cm^2$ of fabric.

8. A protective clothing garment for protection of a wearer thereof against a toxic chemical vapor or gas agent, said protective clothing garment being made of a warp knitted activated-carbon fabric , said fabric having a wept comprising a protective yarn-covered activated-carbon yarn every course thereof being inserted across the full width of said fabric and having non-activated-carbon warp yarns in the wales and courses of said fabric, said fabric being a raschel knit fabric having a design represented by the bar movement pattern:

front guide bar: 4-6, 2-0
back guide bar: 2-0, 2-4.

9. A protective clothing garment according to claim 8, wherein said protective yarn-covered activated-carbon yarn is braided with a cotton yarn.

10. A protective clothing garment according to claim 8, wherein said protective yarn-covered activated-carbon yarn is wrapped with a cotton yarn.

* * * * *

UNITED STATES PATENT OFFICE

CERTIFICATE OF CORRECTION

Patent No. 4,067,210 Dated Jan. 10, 1978

Inventor(s) Gilbert N. Arons et al.

It is certified that error appears in the above-identified patent and that said Letters Patent are hereby corrected as shown below:

Column 3, line 20, "mm" should read --mg--.

Column 6, line 20, "Wrap" should read --Warp--;

line 28, --19.5-- should be inserted before "inches/rack";

line 44, "wrap" should read --warp--; and line 53, "wrap" should read --warp--.

Column 7, line 24, "wrap" should read --warp--; and line 32, "wrap" should read --warp--.

Column 8, all of line 5 should be deleted.

Signed and Sealed this

Ninth Day of May 1978

[SEAL]

Attest:

RUTH C. MASON
Attesting Officer

LUTRELLE F. PARKER
Acting Commissioner of Patents and Trademarks